US006158353A

United States Patent [19]

Theurer

[11] Patent Number: 6,158,353

[45] Date of Patent: Dec. 12, 2000

[54] METHOD OF PERFORMING A TIE REPLACEMENT OPERATION

[75] Inventor: Josef Theurer, Vienna, Austria

[73] Assignee: Franz Plasser Bahnbaumaschinen-Industriegesellschaft m.b.H., Vienna, Austria

[21] Appl. No.: 09/289,465

[22] Filed: Apr. 9, 1999

[30] Foreign Application Priority Data

Apr. 22, 1998 [AT] Austria ..... 680/98

[51] Int. Cl.[7] ..... E01B 27/00

[52] U.S. Cl. ..... 104/9; 104/2; 104/5; 104/6; 104/16; 104/17.1; 29/402.08

[58] Field of Search ..... 104/2, 9, 5, 6, 104/16, 17.1; 29/402.08

[56] References Cited

U.S. PATENT DOCUMENTS

| | | | |
|---|---|---|---|
| 4,018,165 | 4/1977 | Bryan, Jr. | 104/9 |
| 4,955,301 | 9/1990 | Theurer et al. | 104/7.2 |
| 5,048,424 | 9/1991 | Madison et al. . | |
| 5,617,795 | 4/1997 | Glomski et al. . | |
| 5,992,329 | 11/1999 | Scheuchzer et al. | 104/15 |

*Primary Examiner*—S. Joseph Morano
*Assistant Examiner*—Frantz F. Jules
*Attorney, Agent, or Firm*—Horst M. Kasper

[57] ABSTRACT

Before replacing an old tie with a new tie in a railroad track, the associated tie plates are temporarily welded to the respective rail bases of the two rails with the aid of an old rail spike. As soon as the new tie has been inserted under the track, rail spikes are driven in order to establish a final connection between the rail and the new tie, and the welded-on rail spikes are removed

2 Claims, 1 Drawing Sheet

Fig.1
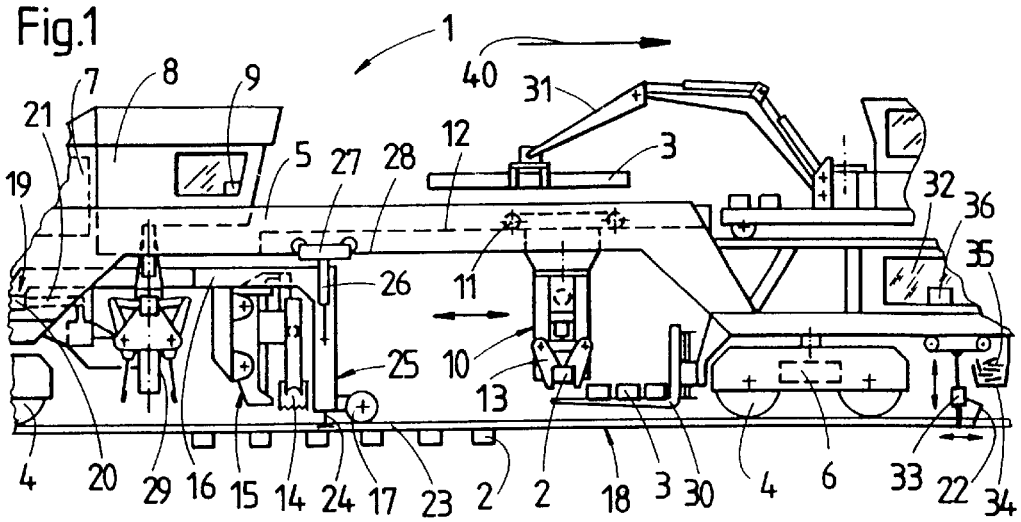
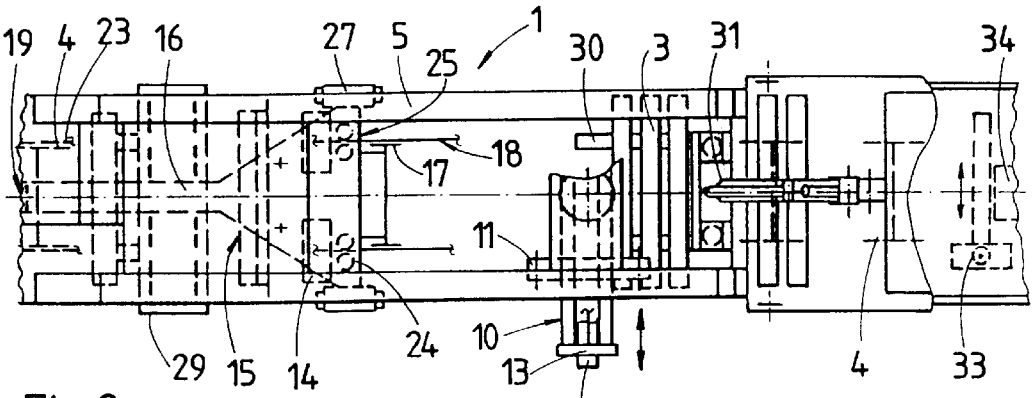
Fig.2
Fig.3
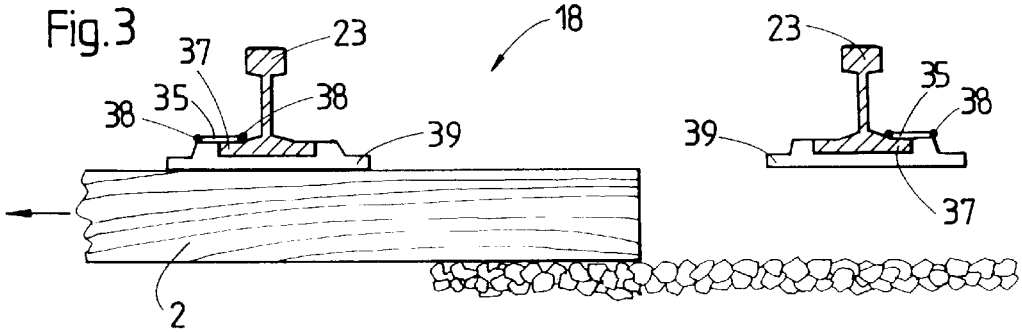

METHOD OF PERFORMING A TIE REPLACEMENT OPERATION

BACKGROUND OF THE INVENTION

1. Field of the Invention

The present invention relates to a method of performing a tie replacement operation in a railroad track extending in a longitudinal direction and comprising rails fastened to ties by means of rail spikes, each rail having a rail base, with a tie plate being positioned in each case between the rail base and tie.

2. Description of the Prior Art

In the course of railroad track maintenance, it is periodically required to replace worn-out or damaged ties. To avoid having to replace the tie plates as well, or having to manipulate these excessively in a time-consuming manner if they drop to the ground, the tie plates are kept in place relative to the rail base during the tie-exchanging operation.

U.S. Pat. No. 5,617,795 describes a tie plate holding apparatus having a tong-like device for gripping the two tie plates of a tie to be replaced. By vertical displacement of the apparatus frame, the tie plates are pressed against the underside or base of the rails which are lifted during the tie exchange.

Similarly, U.S. Pat. No. 5,048,424 discloses a device with which each tie plate is pulled upwards by four electromagnets, used to temporarily secure the tie plates against the rail bases when the rails are lifted for old tie removal and insertion of a new tie into the track.

SUMMARY OF THE INVENTION

It is the primary object of this invention to provide a tie replacement method which allows the tie exchanging procedure to be carried out in a simplified and economical manner.

The above and other objects are accomplished according to the invention with a method of the kind specified above, comprising the steps of extracting the rail spikes from a damaged old tie to be replaced and from the associated tie plates, welding the tie plates to the rail bases of the respective rails, removing the damaged old tie transversely to the longitudinal direction, inserting a new tie underneath the welded-on tie plates transversely to the longitudinal direction, pressing the correctly positioned new tie against the welded-on tie plates, establishing a connection between the rails and the new tie by driving in rail spikes into the tie plates and the new tie, and detaching the welded connection.

By temporarily welding the tie plates to the rails, or rather the rail bases, in this fashion, it is possible to render unnecessary a relatively work-intensive and also time-consuming handling of the tie plates for removal from the old tie which is to be renewed, and a subsequent manipulating to position the tie plate between the rail base and the new tie. According to the invention, merely minimal additional expense is required for spot welding by which the tie plate—still correctly positioned between the rail and the old tie to be replaced—can be fixed to the rail base until the new tie has been inserted and has reached its end position, and a final connection between the new tie and the tie plate can be completed.

According to another feature of the present invention, the method also comprises the step of placing a metal part, preferably a no-longer-usable rail spike, on the tie plate and rail base and connecting said part to at least the tie plate by means of a spot weld in order to establish a temporary welded connection.

BRIEF DESCRIPTION OF THE DRAWING

The above and other objects, advantages and features of the present invention will become more apparent from the following detailed description of a now preferred embodiment thereof, taken together with the accompanying, somewhat schematic drawing wherein FIG. 1 is a partial side elevational view of a machine for performing a tie replacement operation, FIG. 2 is a simplified partial plan view of the machine according FIG. 1, and FIG. 3 is an enlarged cross-section of part of a track.

DETAILED DESCRIPTION OF PREFERRED EMBODIMENT

Referring now to the drawing, FIGS. 1 and 2 show a machine 1 for performing a tie replacement operation. The machine has a machine frame 5 supported at its ends by means of undercarriages 4 on a track 18 extending in a longitudinal direction, the track comprising rails 23 fastened to a succession of ties 2. Provided for the forward travel of the machine 1 in an operating direction, indiciated by arrow 40, is a motive drive 6 which, like all the remaining drives of the machine yet to be described, may be actuated via a central energy unit 7. A central control device 9 is arranged in an operator's cab 8 which is situated—for the purpose of better visibility—immediately above working units described below.

Said working units of the machine 1 include a tie exchanging apparatus 10 for removing individual old ties 2 from the track 18 and inserting new ties 3 in their place. The apparatus 10 is located between the two undercarriages 4 and is vertically and transversely displaceable by drives (not shown) as well as being designed, with the aid of a drive 11, for displacement in the longitudinal direction on a longitudinal guide 12 connected to the machine frame 5. Two grippers 13, squeezable towards one another in the longitudinal direction, are connected to the tie exchanging apparatus 10 for the purpose of seizing the old ties 2 in the end region thereof for removal. A further work unit is in the shape of a ballast clearing device 15 equipped with vertically and transversely adjustable clearing members 14 and mounted on a tool frame 16. The latter is designed to travel on the track 18 by means of an undercarriage 17 arranged in the region of the tie exchange apparatus 10.

In the end region lying opposite the undercarriage 17, the tool frame 16 is articulatedly supported on the machine frame 5 at a hinging point 19 and connected to a longitudinal displacement drive 20. The undercarriage 17, mounted to the tool frame 16, and the immediately adjacent ballast clearing device 15 are arranged between the tie exchanging apparatus 10 and the hinging point 19 which is mounted on longitudinal guides 21, connected to the machine frame 5, for displacement in the longitudinal direction. Linked to the tool frame 16 in the area of the clearing member 14 is a track lifting device 25 having a lifting member 24 designed for application laterally to the rail 23 of the track 18. Furthermore, a lifting drive 26 is hinged to each longitudinal side of the tool frame 16, an upper end of said lifting drive 26 being connected to a carriage 27 which is mounted on a guide 28 of the machine frame 5 for displacement in the longitudinal direction. Located underneath the operator's cab 8 in the region of each rail 23 is a vertically adjustable tamping unit 29.

A tie deposit facility 30, upon which both old and new ties 2,3 may be commonly deposited, is provided on the machine frame 5 and arranged centrally with respect to a direction extending transversely to the longitudinal direction. In the region of said tie deposit facility 30, the machine frame 5 has an opening enabling the passage of a tie gripper 31.

Located at the forward end of the machine 1 with regard to the operating direction, underneath an operator's cab 32, is a welding robot 33 which is vertically, longitudinally and transversely adjustable by means of drives (not shown) and which is suitable for spot welding. A vertically adjustable magnetic gripper 22 is associated with the welding robot 33. A receptacle 34 contains old rail spikes 35 which are no longer fit for use.

In the course of a tie replacement operation, the rail spikes connecting the rails 23 to the old ties 2 are pulled from the old ties which are to be renewed. This is done by means of spike pulling units (not shown) preceding the machine 1 in the operating direction (arrow 40). Those rail spikes 35 too damaged or worn to be re-used as rail fasteners are deposited in the receptacle 34. An operator situated in the operator's cab 32 is now able, by means of a central control device 36, to control the magnetic gripper 22 in order to pick up a single old rail spike 35 from the receptacle 34. This rail spike 35, held by magnetic force, is then pressed upon a rail base 37 and a tie plate 39 associated with the tie 2 to be replaced (see FIG. 3). As a next step, the welding robot 33 carries out a spot weld 38 for temporarily connecting the rail spike 35 to the tie plate 39 and rail base 37.

Subsequently, the old tie 2 to be renewed is pulled laterally from the track 18 with the aid of the tie exchanging apparatus 10 while the rails 23 are slightly raised by means of the track lifting device 25 (see FIG. 3). During this, the tie plates 39 remain attached to the associated rails 23 due to the spot welds 38. Thereafter, again with the aid of the tie exchanging apparatus 10, a new tie 3 is inserted underneath the exposed tie plates 39.

After the new tie 3 inserted in the track 18 has been tamped, rail spikes are driven into the new tie 3 to establish a final rail/tie connection, and the welded-on rail spike 35 is ripped away with the aid of a shearing device (not shown) and fed to a collecting container by magnetic means.

Instead of using a rail spike 35 for establishing a temporary welded connection between tie plate and rail, it would also be conceivable to place the spot weld 38 directly between the tie plate and the rail base. It would, of course, also be possible to use other metallic parts in the place of a rail spike 35.

What is claimed is:

1. A method of performing a tie replacement operation in a railroad track extending in a longitudinal direction and comprising rails fastened to ties by means of rail spikes, each rail having a rail base, with a tie plate being positioned in each case between the rail base and tie, the method comprising the steps of:

(a) extracting the rail spikes from a damaged old tie to be replaced and from the associated tie plates, (b) welding the tie plates to the rail bases of the respective rails, (c) removing the damaged old tie transversely to the longitudinal direction, (d) inserting a new tie underneath the welded-on tie plates transversely to the longitudinal direction, (e) pressing the correctly positioned new tie against the welded-on tie plates, (f) establishing a connection between the rails and the new tie by driving in rail spikes into the tie plates and the new tie, and (g) detaching the welded connection.

2. The method of claim 1, comprising the step of placing a metal part, preferably a no-longer-usable rail spike, on the tie plate and rail base and connecting said part to at least the tie plate by means of a spot weld in order to establish a temporary welded connection.

* * * * *